US005341756A

United States Patent [19]

Hinze

[11] Patent Number: 5,341,756

[45] Date of Patent: Aug. 30, 1994

[54] STORAGE MEANS FOR WATERCRAFT

[76] Inventor: Donald Hinze, N2232 Cleghorn Rd., Waupaca, Wis. 54981

[21] Appl. No.: 107,634

[22] Filed: Aug. 18, 1993

[51] Int. Cl.[5] ..... B63C 7/00

[52] U.S. Cl. ..... 114/54; 114/44

[58] Field of Search ..... 114/44, 48, 49, 50, 114/52–54, 263, 258, 259, 260, 68

[56] References Cited

U.S. PATENT DOCUMENTS 1,796,595 3/1931 Dunbar ..... 114/54

4,075,965 2/1978 Lasch ..... 114/49

*Primary Examiner*—Jesus D. Sotelo

*Attorney, Agent, or Firm*—Russell L. Johnson

[57] ABSTRACT

The invention provides a apparatus for and a method of storing watercraft above a body of water for extended periods of time, including periods when the body of water is frozen over. The apparatus involves flexible, inflatable, toroidal shaped floatation devices which have bands secured thereto for the purpose of positioning and securing the floatation devices relative to the watercraft. The floatation devices are provided with elongated inflation tubes which enable the inflation of the floatation devices from locations a distance from the floatation devices.

5 Claims, 2 Drawing Sheets

FIGURE 1
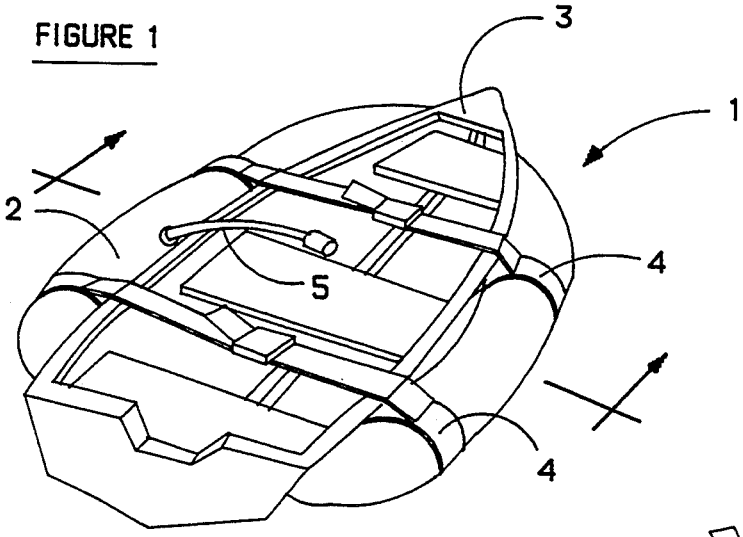
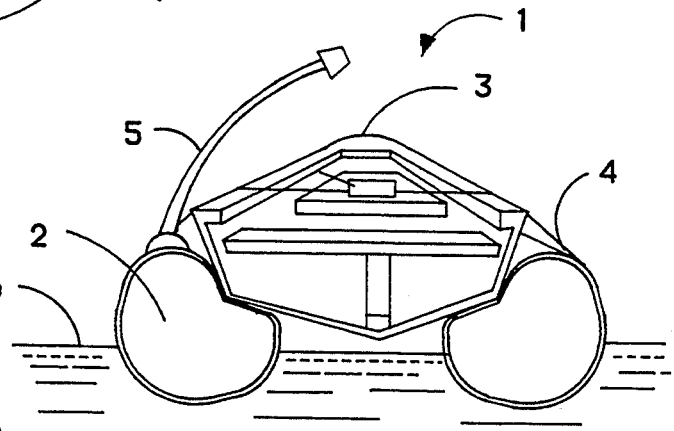
FIGURE 2
FIGURE 3
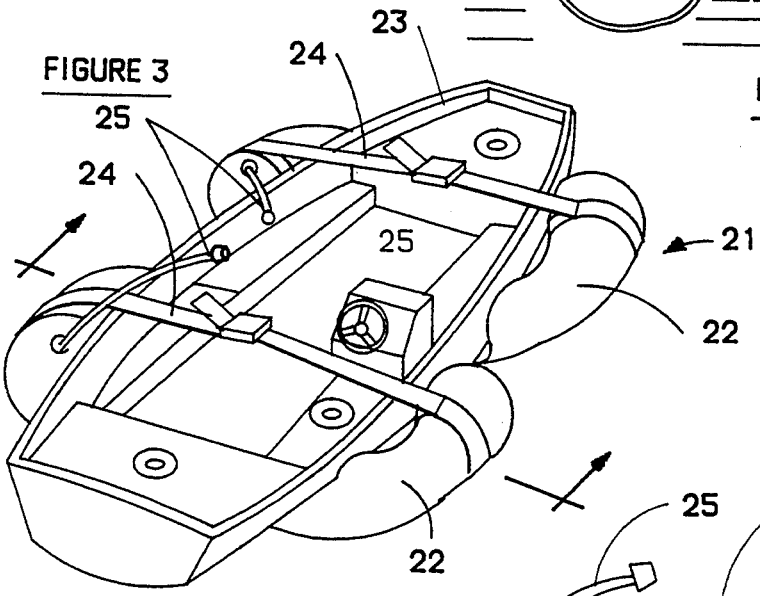
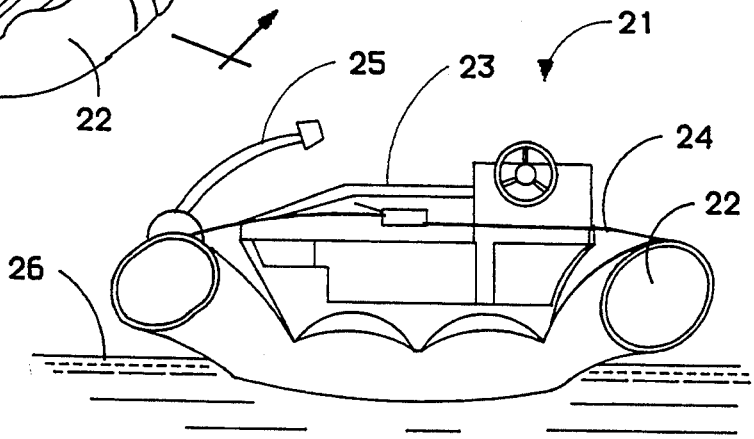
FIGURE 4

STORAGE MEANS FOR WATERCRAFT

BACKGROUND

In areas where bodies of water freeze over in the winter months, it becomes necessary for owners of watercraft to remove their watercraft from the water before the body of water freezes over, to store the watercraft over the winter months, and to return the watercraft to the water when the body of water thaws. Also, during long periods when the watercraft is not in use, it is desirable to store the watercraft out of the water. This often requires significant structures and hoists.

These actions often consume a considerable amount of time, effort and money. The organizing and coordinating of arrangements for removing the watercraft can be time consuming and expensive.

Equipment needed to raise the watercraft out of the water is often large and expensive and difficult to store when not in use.

OBJECTS

It is, therefore, an object of this invention to provide storage means for watercraft wherein the storage means is; small, is low cost, is easy to store while, at the same time, providing a means for lifting a watercraft above a body of water and for storing the watercraft, on site, in place, on the lifting means, and over the body of water for extended periods of time.

It is further an object of this invention to provide the storage means described above wherein the storage means is inflatable and adaptable to use with most small and medium sized watercraft.

It is further an object of this invention to provide the storage means described above wherein the storage means is capable of storing a watercraft above a body of water during the winter months when the body of water is frozen.

Other objects will be made apparent from the following specifications, drawings and claims.

PRIOR ART

Devices for lifting watercraft are some of the oldest found in the patent art. One of the earliest patents issued in the United States was U.S. Pat. No. 6,409, May 22, 1849 for a Manner of Bouying Vessels, issued to Abraham Lincoln of Springfield Ill. The invention teaches a multiplicity of buoyant chambers that can be lowered into the water to raise a vessel over shoals.

U.S. Pat. No. 511,472, December 1893, to Sumovski teaches buoyant bags in the form of rings as inflatable structures. Sumovski also teaches the use of a raft-like bearer which can lift a ship out of the water.

U.S. Pat. No. 515,878 to Hadley and Foster, March 1894 teaches a multiplicity of inflatable bags covered with a heavy netting of cord or rope, joined together by chains, and connected to tubes which carry air from the vessel to the inflatable bags.

All three of the above inventions are a century or more old. They collectively teach many of the elements of this invention. They do not teach the combinations of this invention.

U.S. Pat. No. 4,075,965, February 1978, to Lasch teaches inflatable cylindrical bodies which are positioned beneath a boat and secured in place with straps for the purpose of lifting the boat high enough in the water to drain water from the boat through the transom drain opening.

The inventor knows of no prior art that employs the means described above in the combinations used in this invention.

Further, the inventor knows of no prior art teachings for using the means described for the purpose of raising a watercraft above a body of water and retaining it there, as a storage means, during a period when the body of water is frozen over.

BRIEF DESCRIPTION

The apparatus of this invention, for raising and storing watercraft, comprises; at least one flexible inflatable toroidal shaped floatation device, at least one pair of bands secured to the floatation device at locations around the perimeter of the floatation device, and at least one elongated tube connected to the floatation device and the tube serves a means for achieving inflation of the floatation device from a location at a distance from the floatation device.

The method of employing the apparatus of this invention comprises; the steps of, positioning a flexible inflatable toroidal shaped floatation device, under a watercraft which is floating on a body of water, securing the floatation device in position relative to the watercraft by means of bands secured to the floatation device, inflating the floatation device until the watercraft is raised above the level of the body of water, and maintaining the watercraft raised above the body of water for an extended period of time, including a period wherein, possibly, the body of water has frozen and thawed.

BRIEF DESCRIPTION OF THE DRAWINGS

FIG. 1 is a pictorial view of a watercraft having the apparatus of this invention secured thereto.

FIG. 2 is a transverse elevational sectional view of the watercraft and apparatus of FIG. 1.

FIG. 3 is a pictorial view of a watercraft which has more than one floatation device made according to this invention secured thereto.

FIG. 4 is a transverse elevational view of the watercraft and device of FIG. 3.

DETAILED DESCRIPTION

Figure 5:
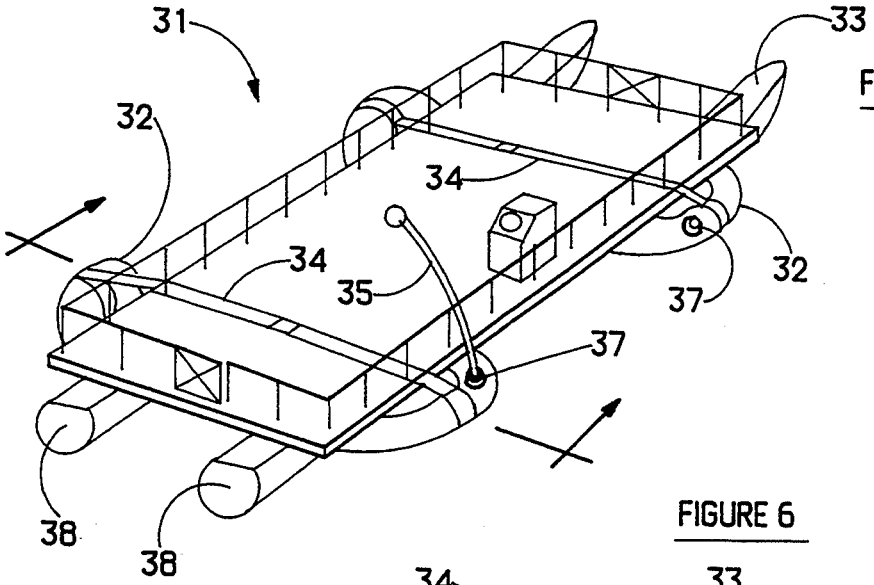
FIG. 5 is a pictorial view of another embodiment of this invention wherein a watercraft has a multiplicity of floatation devices made according to this invention and secured thereto.

The term "accommodating" as used herein shall be read to mean "to adapt to or to conform to".

Referring now to FIGS. 1 and 2 wherein the invention is shown in its simplest form. Boat storage assembly 1 has as a part thereof toroidal floatation means 2, watercraft 3, securement bands 4, which are secured to floatation means 2 and serve to secure floatation means 2 in place relative to watercraft 3, and an elongated inflation tube 5 serves to permit the inflation of floatation means 2 from a location a distance from floatation means 2.

The embodiment of FIGS. 1 and 2 is illustrative of the elements of this invention.

Toroidal floatation means 2 is toroidal in shape and configured so as to accommodate to the contours of the underside of watercraft 3 and to distribute the buoyant forces of floatation means 2 beneath watercraft 3 so as to create a very stable combination. Floatation means 2 may be a conventional innertube for a vehicle tire. Inner tubes are low cost, readily available, and can serve adequately as the floatation means 2 of this invention. However, in more preferred embodiments of the invention floatation means 2 may be of fiber reinforced natural or synthetic rubber, and have incorporated therewith means (not shown) for protecting zones of floatation means 2 from damage in instances where damage to floatation means 2 is anticipated.

Watercraft 3 is shown to be a row boat and to represent a relatively small watercraft.

Securement bands 4 may be cords of natural or synthetic fibers secured to each other or watercraft 3 by means of knotting and tying or any other suitable means. However, in more preferred embodiments, straps or bands of woven, natural or synthetic, fibers are preferred. Such straps or bands are of low cost and readily available and serve their intended purposes well. In some applications it is preferred that bands 4 be free to slide on the perimeter of floatation means 2 to facilitate manipulation and positioning of floatation means 2 and bands 4. In other applications it is preferred that bands 4 be secured in place on floatation means 2.

Elongated inflation tube 5 may be a valve stem extension for an innertube inflation valve such as those found on the tires of many vehicles. However, in more complex applications than that of FIG. 1, it is preferred that a multiplicity of inflation tubes be brought to a common location. In such cases tubes of any desired length can be readily made up from materials available at many industrial or automotive supply houses.

As shown in FIG. 2, watercraft 3 is raised above the surface 6 of a body of water and in the configuration shown is very stable so that watercraft 3 may be stored in the shown configuration for long periods of time and under nearly all weather conditions.

Also, as shown in FIG. 2 floatation means 2 aligns with and accommodates to the contours of watercraft 3. This attribute of the toroidal shape of floatation means 2 permits floatation means 2 to be subjected to the displacing and deforming forces that accompany severe weather, and the expansions and contractions of ice during ice-up and ice-out periods and still maintain watercraft 3 securely above the surface 6 of a body of water.

The method of achieving assembly 1 comprises the steps of positioning a flexible inflatable toroidal shaped floatation means 2 beneath a watercraft 3, securing floatation means 2 in position relative to watercraft 3 by means of bands 4, positioned at locations around the perimeter of floatation means 2, and inflating floatation means 2 so as to raise watercraft 3 above the surface 6 of a body of water.

Referring now to FIGS. 3 and 4 wherein boat storage assembly 21 is shown to comprise, watercraft 23, supported above the surface 26 of a body of water by toroidal floatation means 22 which are secured in place relative to watercraft 23 by means of bands 24. Floatation means 22 are inflatable by means of elongated inflation tubes 25.

Watercraft 23 is here shown to be a pleasure boat or a larger fishing boat, wherein a multiplicity of floatation means 22 are positioned along watercraft 23 and span the irregular undersurface of watercraft 23. Elongate inflation tubes 25 are brought to a single location in watercraft 23 from which floatation means 22 may be inflated. Bands 24 secure floatation means 22 in place relative to watercraft 23.

As illustrated in FIGS. 4 and 5, a multiplicity of the floatation means 22 of this invention can serve to raise and store a watercraft 23 above the surface 26 of a body of water. As further illustrated in FIGS. 4 and 5, the toroidal shape of floatation means 22 serves to provide a very stable and accommodating platform upon which to store a watercraft 23 above a body of water. FIG. 4 in particular illustrates the ability of floatation means 22 to accommodate to an irregularly shaped hull.

Figure 6:
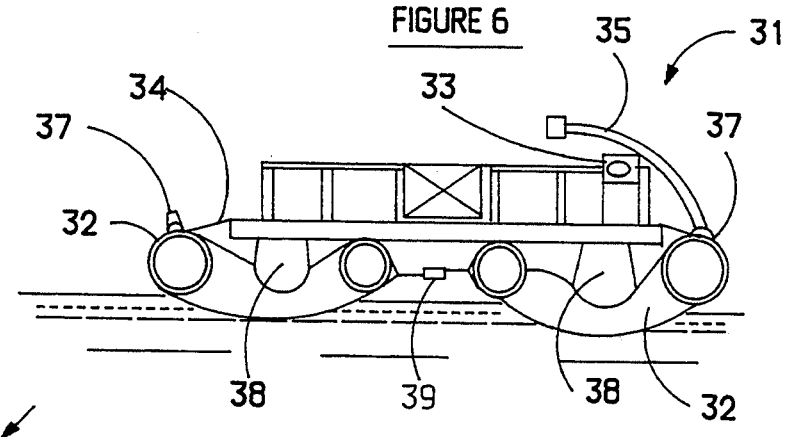
FIG. 6 is a transverse elevational sectional view of the embodiment of FIG. 5.

Referring now to FIGS. 5 and 6 wherein boat storage assembly 31 comprises watercraft 33 supported by a multiplicity of toroidal floatation means 32 which are held in place relative to watercraft 33 by means of securement bands 34. Floatation means 32 are provided with valve stems 37 which may be detachably connected to elongated inflation tubes 35 for the purpose of inflating floatation means 32.

Watercraft 33 is here shown to be a pontoon boat and watercraft 33 is supported by multiple toroidal shaped floatation means 32 positioned along each of pontoons 38.

As shown in FIG. 6, toroidal floatation means 32 may be further linked to each other by means of coupling bands 39 which may be cords of natural or synthetic fibers or straps of woven fibers.

In use, toroidal shaped floatation means 32 may be linked together by bands 39 and have bands 34 secured thereto prior to positioning the joined floatation means under watercraft 33. Bands 34 may then serve to guide and position the linked floatation means under watercraft 33. It should be noted that the positioning of the floatation means 32 under the watercraft 33 can be accomplished by someone located on watercraft 33. Detachable elongated inflation tubes 35 may be secured to valve stems 37 of floatation means 32 and brought to a common point for controlled lifting of watercraft 33.

Figure 8:
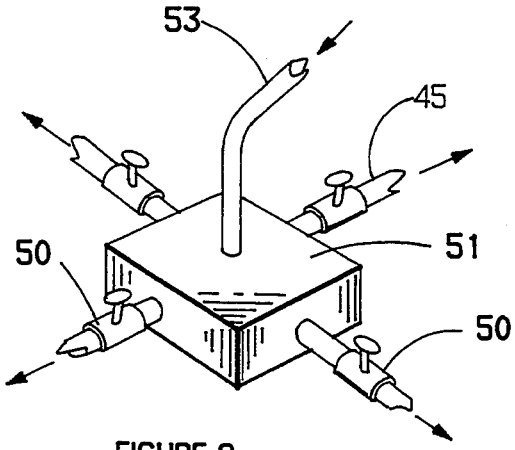
FIG. 8 is a schematic pictorial view of a valving configuration for use with the inflation means of FIG. 7.
Figure 7:
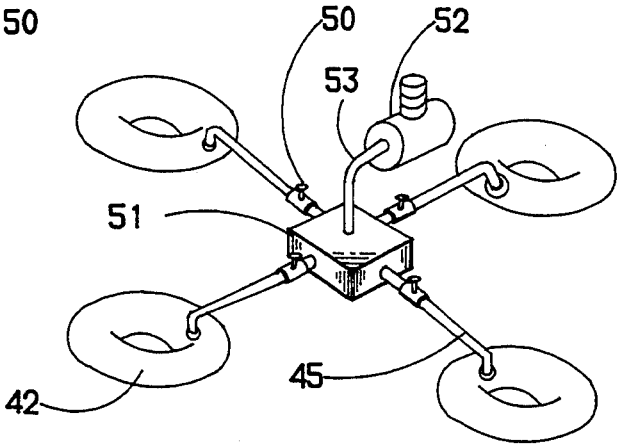
FIG. 7 is a schematic pictorial view of an inflation means for use with the apparatus of this invention.

The means for controlling the lifting of watercraft 33 is further illustrated by FIGS. 7 and 8. Toroidal floatation means 42 are connected through elongated inflation tubes 45 to valved outlets 50. Valved outlets 50 are joined to manifold block 51, which is joined to air pump 52 through input line 53.

In use, once floatation means 42 are secured in position under a watercraft, and inflation tubes 45 are joined to outlets 50 and pump 52 is joined to manifold block 51 by means of input line 53, pump 52 is put into operation and air can be pumped into all of the floatation means 42 simultaneously. If, as the floatation means 42 are inflated and the watercraft is being raised, it is seen that the craft is raising unevenly, valves 50 can be used to regulate the flow of air to the individual floatation means 42 to compensate for any imbalance in the watercraft and to raise the watercraft evenly above the water.

Once raised, the watercraft can be stored, above the body of water, in the raised position for an indefinite period of time. The flexibility and accommodating attributes of the toroidal shaped floatation means provides a very reliable and stable storage support for a watercraft. In addition the flexibility and accommodating attributes of the toroidal shaped floatation means permits the storage of the watercraft above the water for a period in which the water freezes and thaws.

The above disclosure is an enabling disclosure and represents the best known modes of practicing the invention known to the inventor at the time of preparation of this application.

However, the scope of this invention should not be limited to the scope of the disclosed embodiments, but rather, the scope of the invention should only be limited by the scope of the appended claims and all equivalents thereto that would become apparent to one skilled in the art.

What is claimed is:

1. An inflatable support apparatus for lifting and supporting a watercraft above a surface for an extended period of time, comprising;

1) at least one toroidal shaped inflatable accommodating support body, for lifting and supporting a watercraft above a surface and at least two separate segments of the support body pass under the watercraft, 2) securement bands joined with the support body at locations around the perimeter of the support body and said bands serve to position and secure the support body in place relative to the watercraft, 3) an inflation means having as a part thereof an elongate tube through which said inflatable support body is inflatable from a location at a distance from the support body.

2. The apparatus of claim 1 wherein said toroidal shaped inflatable support body is an inner tube, and said surface is a surface of a body of water, and said bands are straps formed of woven fibers.

3. The apparatus of claim 1 wherein the toroidal body is made of reinforced rubber and the bands are joined to the toroidal body at points of attachment around the toroidal body.

4. The apparatus of claim 1 wherein the apparatus comprises more than one inflatable toroidal shaped body and the toroidal shaped bodies are joined by bands and the toroidal shaped bodies are independently inflatable so as to form a multiplicity of lifting and supporting elements for lifting and supporting a watercraft above a support surface.

5. A method for lifting and storing a watercraft above the surface of a body of water comprising; the steps of, 1) positioning a flexible, inflatable, toroidal shaped floatation apparatus beneath a watercraft, 2) securing the floatation apparatus in position beneath the watercraft by means of bands secured to the floatation apparatus.

3) inflating the floatation apparatus until the watercraft is raised above the surface of the body of water, and 4) retaining the watercraft raised above the surface of the body of water for an extended period of time.

* * * * *